US006333860B1

(12) United States Patent
Oliphant et al.

(10) Patent No.: US 6,333,860 B1
(45) Date of Patent: Dec. 25, 2001

(54) EMI SHIELD WITH CONNECTOR COVER EXTENSION

(75) Inventors: David Oliphant, Salt Lake City; Brent Madsen, Providence, both of UT (US); Michael Cochrane, San Jose, CA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/528,502

(22) Filed: Mar. 20, 2000

(51) Int. Cl.[7] ..... H01R 9/03

(52) U.S. Cl. ..... 361/818

(58) Field of Search ..... 439/640, 131, 439/946, 76.1, 945, 76, 638, 607–610; 361/683, 727, 816, 818, 736

(56) References Cited

U.S. PATENT DOCUMENTS

| | | | |
|---|---|---|---|
| Re. 35,873 | 8/1998 | Simmons et al. | 361/818 |
| 2,916,720 | 12/1959 | Steans | 339/91 |
| 4,186,988 | 2/1980 | Kobler | 339/176 |
| 4,241,974 | 12/1980 | Hardesty | 339/154 |
| 4,303,296 | 12/1981 | Spaulding | 339/122 |
| 4,352,492 | 10/1982 | Smith | 273/1 |
| 4,407,559 | 10/1983 | Meyer | 339/126 |
| 4,428,636 | 1/1984 | Kam et al. | 339/97 |
| 4,710,136 | 12/1987 | Suzuki | 439/374 |
| 4,778,410 | 10/1988 | Tanaka | 439/676 |
| 4,875,872 | 10/1989 | Tanaka | 439/344 |
| 4,915,648 | 4/1990 | Takase et al. | 439/490 |
| 5,051,099 | 9/1991 | Pickles et al. | 439/108 |
| 5,139,439 | 8/1992 | Shie | 439/359 |
| 5,183,404 | 2/1993 | Aldous et al. | 439/55 |

(List continued on next page.)

FOREIGN PATENT DOCUMENTS

| | | | |
|---|---|---|---|
| 61-256850 | 8/1985 | (JP) . | |
| 10-156006 | * 12/1997 | (JP) | 439/74 |
| WO95/13633 | 5/1995 | (WO) . | |

OTHER PUBLICATIONS

P.E. Knight and D.R. Smith, "Electrical Connector for Flat Flexible Cable," IBM Technical Disclosure Bulletin, vol. 25, No. 1, Jun. 1982.

U.S. application No. 09/528,330, Oliphant et al., filed Mar. 20, 2000.

U.S. application No. 09/528,331, Oliphant et al., filed Mar. 20, 2000.

U.S. application No. 09/528,500, Oliphant et al., filed Mar. 20, 2000.

U.S. application No. 09/528,501, Oliphant et al., filed Mar. 20, 2000.

*Primary Examiner*—Neil Abrams
*Assistant Examiner*—J. F. Duverne
(74) *Attorney, Agent, or Firm*—Workman, Nydegger & Seeley

(57) ABSTRACT

A communications card includes a housing formed by a top cover and a lower cover panel. The top cover is constructed from a generally non-conductive material and the lower cover panel is constructed from a conductive material. A substrate is disposed within the housing and a conductive panel is positioned between the substrate and the top cover. The conductive panel overlies at least a portion of the substrate, and the conductive panel and lower cover panel are electrically connected to ground when the communications card is inserted into a host device in order to decrease the electromagnetic radiation emitted by the communications card. Preferably, the communications card conforms to the standards established for a PCMCIA Type III card. Additionally, the communications card may include a modular jack with a main body portion having a top surface, a bottom outer surface and a front surface. A receptacle is disposed entirely within the front surface of the modular jack such that no portion of a corresponding plug extends through either the top surface or the bottom surface of the main body portion of the modular jack.

33 Claims, 6 Drawing Sheets

U.S. PATENT DOCUMENTS

| | | | | |
|---|---|---|---|---|
| 5,184,282 | | 2/1993 | Kaneda et al. | 361/395 |
| 5,310,360 | | 5/1994 | Peterson | 439/571 |
| 5,336,099 | | 8/1994 | Aldous et al. | 439/131 |
| 5,338,210 | | 8/1994 | Beckham et al. | 439/131 |
| 5,364,294 | | 11/1994 | Hatch et al. | 439/676 |
| 5,391,083 | * | 2/1995 | Roebuck et al. | 439/76 |
| 5,391,094 | | 2/1995 | Kakinoki et al. | 439/638 |
| 5,392,192 | * | 2/1995 | Dunn et al. | 361/683 |
| 5,411,405 | | 5/1995 | McDaniels et al. | 439/131 |
| 5,425,660 | | 6/1995 | Weikle | 439/676 |
| 5,429,522 | | 7/1995 | Noschese et al. | 439/133 |
| 5,478,261 | | 12/1995 | Bogese, II | 439/676 |
| 5,481,616 | | 1/1996 | Freadman | 381/90 |
| 5,499,923 | | 3/1996 | Archibald et al. | 439/26 |
| 5,505,633 | | 4/1996 | Broadbent | 439/329 |
| 5,509,811 | | 4/1996 | Homic | 439/55 |
| 5,538,442 | | 7/1996 | Okada | 439/676 |
| 5,546,278 | | 8/1996 | Bethurum | 361/737 |
| 5,547,401 | | 8/1996 | Aldous et al. | 439/676 |
| 5,561,727 | | 10/1996 | Akita et al. | 385/88 |
| 5,562,504 | | 10/1996 | Moshayedi | 439/638 |
| 5,580,274 | | 12/1996 | Tsair | 439/571 |
| 5,608,607 | | 3/1997 | Dittmer | 361/686 |
| 5,634,802 | | 6/1997 | Kerklaan | 439/131 |
| 5,660,568 | | 8/1997 | Moshayedi | 439/654 |
| 5,677,511 | | 10/1997 | Taylor et al. | 174/52.2 |
| 5,679,013 | | 10/1997 | Matsunaga et al. | 439/144 |
| 5,696,699 | * | 12/1997 | Bassler et al. | 361/816 |
| 5,727,972 | | 3/1998 | Aldous et al. | 439/655 |
| 5,768,110 | | 6/1998 | Frommer et al. | 361/755 |
| 5,773,332 | | 6/1998 | Glad | 439/344 |
| 5,774,344 | | 6/1998 | Casebolt | 361/800 |
| 5,775,951 | * | 7/1998 | Gargiulo | 469/640 |
| 5,784,259 | | 7/1998 | Asakura | 361/752 |
| 5,791,943 | | 8/1998 | Lo et al. | 439/676 |
| 5,797,771 | | 8/1998 | Garside | 439/610 |
| 5,816,832 | | 10/1998 | Aldous et al. | 439/131 |
| 5,833,473 | | 11/1998 | Betker et al. | 439/76.1 |
| 5,844,784 | | 12/1998 | Moran et al. | 361/818 |
| 5,879,170 | | 3/1999 | Nogami | 439/76.1 |
| 5,890,917 | | 4/1999 | Ishida et al. | 439/101 |
| 5,896,274 | | 4/1999 | Ishida | 361/737 |
| 5,912,806 | | 6/1999 | Onoda et al. | 361/737 |
| 5,920,460 | | 7/1999 | Oldendorf et al. | 361/753 |
| 5,940,275 | | 8/1999 | Laity | 361/737 |
| 5,966,294 | | 10/1999 | Harada et al. | 361/794 |
| 6,018,461 | | 1/2000 | Biermann et al. | 361/737 |
| 6,122,175 | * | 9/2000 | Shieh | 361/737 |

* cited by examiner

EMI SHIELD WITH CONNECTOR COVER EXTENSION

BACKGROUND OF THE INVENTION

1. The Field of the Invention

The present invention generally relates to electronic devices such as computers. More specifically, the present invention relates to communications cards that allow electronic devices and communications systems to be interconnected.

2. Description of Related Art

Portable computers and other electronic equipment frequently use communications cards to allow electrical communication to be established between electronic devices or to allow electronic devices to be connected to communication systems. The communications cards are typically located internally within the computer or electronic equipment and the cards are relatively small in size. These communications cards, for example, are commonly used with modems, fax/modems, Local Area Network (LAN) adaptors and cellular telephone equipment.

Conventional communications cards are often constructed according to the Personal Computer Memory Card International Association (PCMCIA) guidelines, which set forth the physical specifications and electronic architecture of the cards (also known as PC cards), and the ports or sockets into which the cards are inserted. The PCMCIA guidelines define three types of cards and sockets for support of electronic equipment. For instance, PCMCIA standards require all PC cards to have the same length and width (roughly the size of a credit card), and each card includes a connector to allow it to be connected to the host device. In particular, according to the known PCMCIA standards, PC cards have a length of 85.6 mm (3.4 inches), a width of 54.0 mm (2.1 inches), and a height of 3.3 mm (0.1 inches), 5.0 mm (0.2 inches) or 10.5 mm (0.4 inches) depending upon if the card is a Type I card, Type II card or Type III card, respectively. Type I PC cards are typically used for memory devices such as read only memory (RAM), flash memory or static random access memory (SRAM). Type II PC cards are generally used with input/output (I/O) devices such as data/fax modems, LANS and mass storage devices. Type III PC cards are used for devices whose components are thicker and require additional space. The PCMCIA guidelines also define corresponding types of sockets. Type I sockets support only Type I cards, Type II sockets support Type I and II cards, and Type III sockets supports all three types of cards.

A conventional PC card has a generally rectangular shaped body with a top surface, bottom surface, opposing sidewalls, front end and a rear end. The terms "front" and "rear" are used in reference to the direction in which the PC card is inserted into the receiving socket in the electronic device. A substrate such as a printed circuit board is disposed within the PC card and the substrate includes various electronic components that provide the necessary circuitry to perform the intended functions of the PC card. The front end of the PC card includes a 68-pin connector that is used to connect the card to the electronic device, such as a notebook or lap top computer.

In greater detail, when a conventional PC card is inserted into the socket in the electronic device, the 68-pin connector is connected to a corresponding receptacle or receiving portion. The receiving portion is typically a multiple pin connector that allows electrical communication to be established between the PC card and the electronic device. The receiving pin connector is typically sized and configured to closely receive the 68-pin connector and create an interference or friction engagement between the 68-pin connector and the receiving pin connector. This friction or interference fit helps hold the PC card within the socket and prevent the unintentional removal of the PC card from the socket.

The top surface of the 68-pin connector is freely exposed to allow the connector to be inserted into the receiving pin connector. Specifically, the top cover does not extend over the upper surface of the 68-pin connector because of the tight tolerances and close fit of the 68-pin connector within the receiving pin connector. Disadvantageously, because the top surface of the 68-pin connector is exposed, it can be easily damaged, scratched, dented and otherwise abused. Significantly, if the 68-pin connector is broken or severely damaged, it typically cannot be repaired and the entire PC card must be replaced. Additionally, the 68-pin connector does not provide any shielding or protection from electromagnetic radiation. Thus, the connector may cause electromagnetic interference (EMI), for example, with the host electronic device, the PC card itself, or other nearby electronic equipment.

In addition, conventional PC cards often have a gap between the body of the card and the connector because the top cover of the card does not extend over the upper surface of the 68-pin connector. Disadvantageously, this gap allows dirt, foreign objects and other materials to get inside the body of the card, and these foreign objects may damage the sensitive electronic components located inside the card. In severe instances, the foreign objects may short circuit the card or otherwise cause the card to fail. Additionally, the gap creates a potential electrical hazard because if electrically conducting material is inserted into the gap and it contacts components or wires with the card, this may create an electric shock danger.

SUMMARY OF THE INVENTION

A need therefore exists for a communications card that overcomes the above-identified disadvantages and problems. In particular, there is a need for a communications card that protects the connector from damage, prevents foreign matter from entering the card and decreases the emission of electromagnetic radiation.

One aspect of the communications card is a conductive panel, such as a metal shield, that decreases the emission of electromagnetic radiation from the card. Significantly, decreasing the emission of electromagnetic radiation helps prevent electromagnetic interference (EMI) with the host device, the card itself and nearby electronic components. Preferably, the conductive panel is electrically connected to a conductive portion of the housing of the communications card, such as the lower panel. The conductive portion of the housing desirably provides a ground path to the host device when the communications card is inserted into the host device.

Another aspect of the communications card is a metal shield located between the top cover of the communications card and a substrate positioned within the housing of the card. The shield preferably covers substantially the entire substrate, but it could cover only a portion of the substrate. The shield may also contain one or more openings or cutouts, for example, to accommodate various components located on the substrate. The metal shield preferably has sufficient thickness and other desirable characteristics to prevent or decrease the emission of electromagnetic radiation from the communications card.

A further aspect of the communications card is a shield with an extension that extends over the upper surface of the connector located at the front end of the communications card. The extension is preferably sized and configured to allow the communications card to be connected to a conventional receiving pin connector located in the socket of the host device. Desirably, the extension has a thickness generally equal to or less than about 0.008 to 0.010 inches (0.2032 to 0.254 mm) so as not to interfere with the connection of the communications card and the receiving pin connector. The connector of the communications card, however, can be connected to any suitable connector and the receiving pin connector does not have to be located in a socket of an electronic device.

Yet another aspect of the present invention is communications card with a protective panel that covers the upper surface of the connector of the communications card. The protective panel helps prevent damage, such as dents and scratches, to the upper surface of the connector. Advantageously, the protective panel may also prevent the connector from being broken.

A still further aspect of the communications card is a panel that fills the gap between the top cover and the connector located at the front end of the communications card. This panel helps prevent foreign objects and other matter from entering the body of the card, which may avert damage or failure of the card. Additionally, this panel helps prevent an electric shock hazard because electrically conducting materials cannot be inserted through the gap and be electrically connected to wires or other components located within the card.

Yet another aspect of the communications card is an insulator that is positioned between the conductive panel and the substrate and/or the conductive panel and the connector. This insulator helps prevent undesirable electrical communication between the conductive shield and the substrate or connector. the insulator is preferably a dielectric material, such as insulative tape, that insulates to about 1.5 kilovolts.

Advantageously, the conductive panel for the communications card is relatively simple to manufacture and assemble. For example the conducter panel and the inner surface of the top cover preferably have the same general configuration and these components can be simply and easily connected. Additionally, the conductive panel is desirably constructed as an integral, one-piece component that performs multiple functions such as protecting the connector, decreasing EMI and preventing foreign objects from entering the communications card. The panel, however, may also be constructed from multiple components that are sized and configured to perform the desired functions. Further, the shield is preferably electrically connected to a metal lower portion of the housing of the communications card to provide a ground path to the host device when the card is inserted into the host device.

Further aspects, features and advantages of the present invention will become apparent from the detailed description of the preferred embodiments that follows.

BRIEF DESCRIPTION OF THE DRAWINGS

The appended drawings contain figures of preferred embodiments of the conductive panel for a communications card. The above-mentioned features of the communications card, as well as other features, will be described in connection with the preferred embodiments. These illustrated embodiments, however, are only intended to illustrate the invention and not limit the invention. The drawings contain the following figures.

DETAILED DESCRIPTION OF THE PREFERRED EMBODIMENTS

The present invention involves a conductive panel or protective shield for a communications card. The principles of the present invention, however, are not limited to conductive panels and protective shields for communications cards. It will be understood that, in light of the present disclosure, the conductive panels and protective shields disclosed herein can be successfully used in connection with other types of electrical equipment, devices and communications systems.

Additionally, to assist in the description of the conductive panels and protective shields for communications cards, words such as top, bottom, front, rear, right and left are used to describe the accompanying figures. It will be appreciated, however, that the present invention can be located in a variety of desired positions—including various angles, sideways and even upside down. A detailed description of the conductive panels and protective shields for communications cards now follows.

Figure 1:
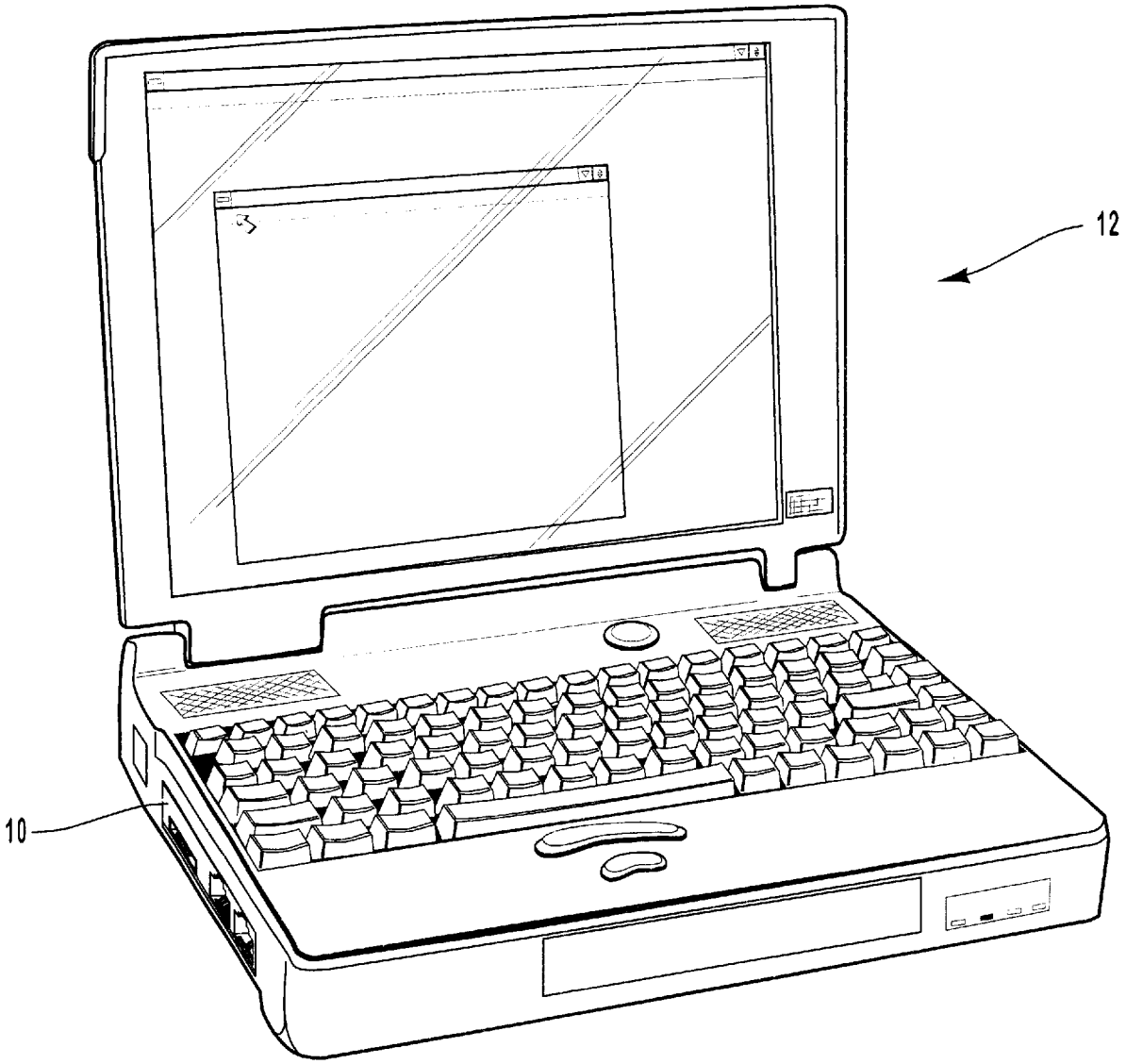
FIG. 1 is a perspective view of a host device such as a conventional computer, illustrating a communications card in accordance with a preferred embodiment of the present invention inserted into a slot or socket in the host device.

As seen in FIG. 1, a communications card 10 according to a preferred embodiment of the present invention is inserted into a corresponding socket or slot in a host device such as a computer 12. The computer 12 can be any type of a wide variety of computers includes personal, portable, laptop, notebook, palm, personal data assistants (PDAS), etc. One skilled in the art will appreciate, however, that the host device can be any suitable type of electronic device.

Figure 2:
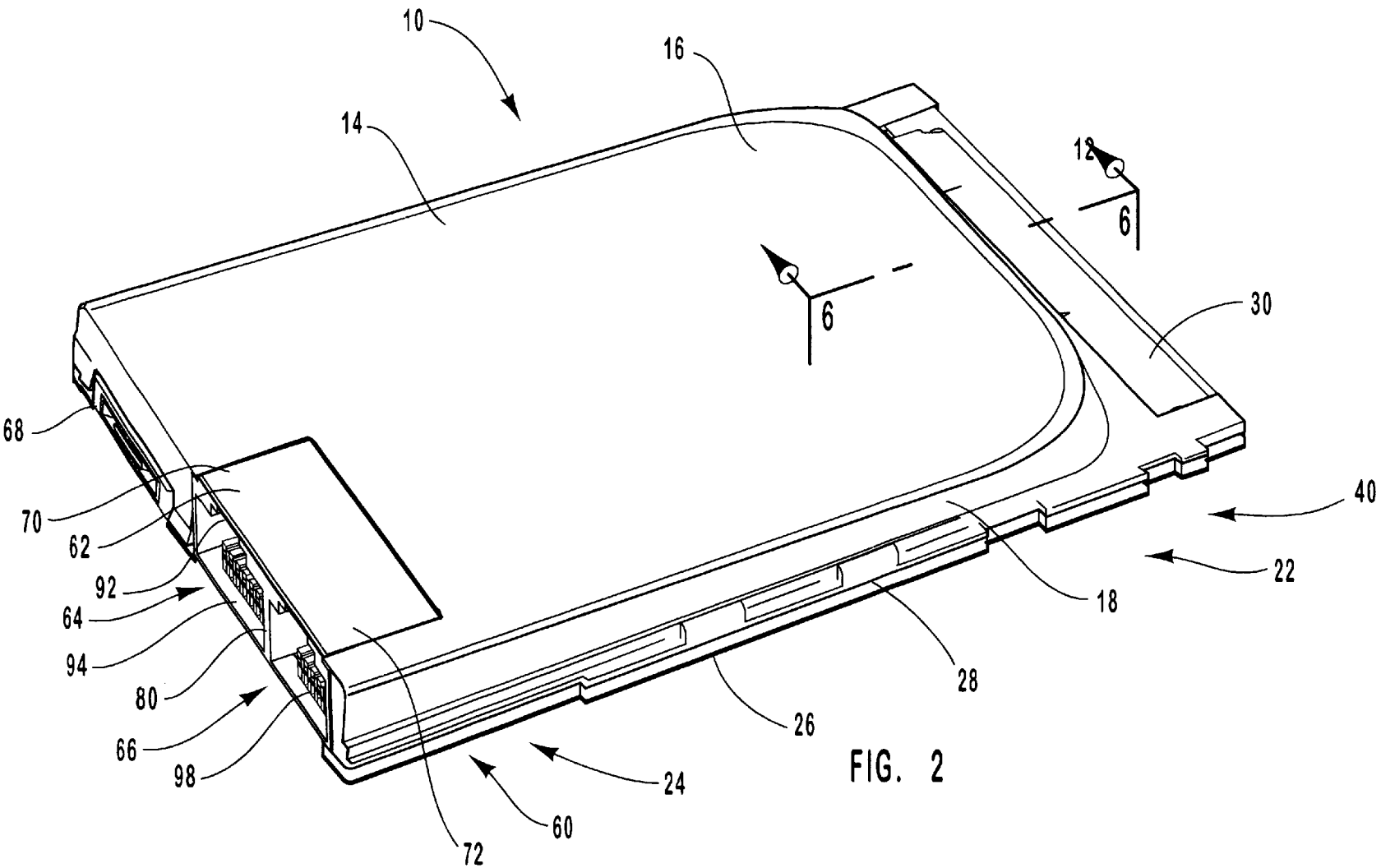
FIG. 2 is a perspective view of a communications card in accordance with another preferred embodiment of the present invention.

The communications card 10, as best seen in FIG. 2, preferably conforms to the Type III PCMCIA standards with a length of 85.6 mm (3.4 inches), a width of 54.0 mm (2.1 inches), and a height of 10.5 mm (0.4 inches), but it will be appreciated that the card may conform to other PCMCIA standards. The communications card 10 may also have other desired sizes and configurations that are suitable for its intended purpose, and the card does not have to conform to any specific standards or guidelines.

The communications card 10 includes a top cover 14 with an upper surface 16, right side 18, left side 20, front end 22 and rear end 24. The communications card 10 also includes a lower cover panel 26 disposed upon the lower surface 28 of the card. Additionally, the communications card 10 includes a connector 30 located at the front end 22 of the card to allow the card to communicate with the host device 12. In particular, the connector 30 allows the communications card 10 to be removably coupled to a corresponding receiving portion or pin connector (not shown) located within the slot or socket in the host device 12. The receiving pin connector is preferably constructed according to the known PCMCIA standards, but it may have other suitable configurations. It will be appreciated that other suitable types of connectors, such as serial, parallel, SCSI, or other types of ports, may also be used to connect the communications card 10 to the computer 12.

Figure 4:
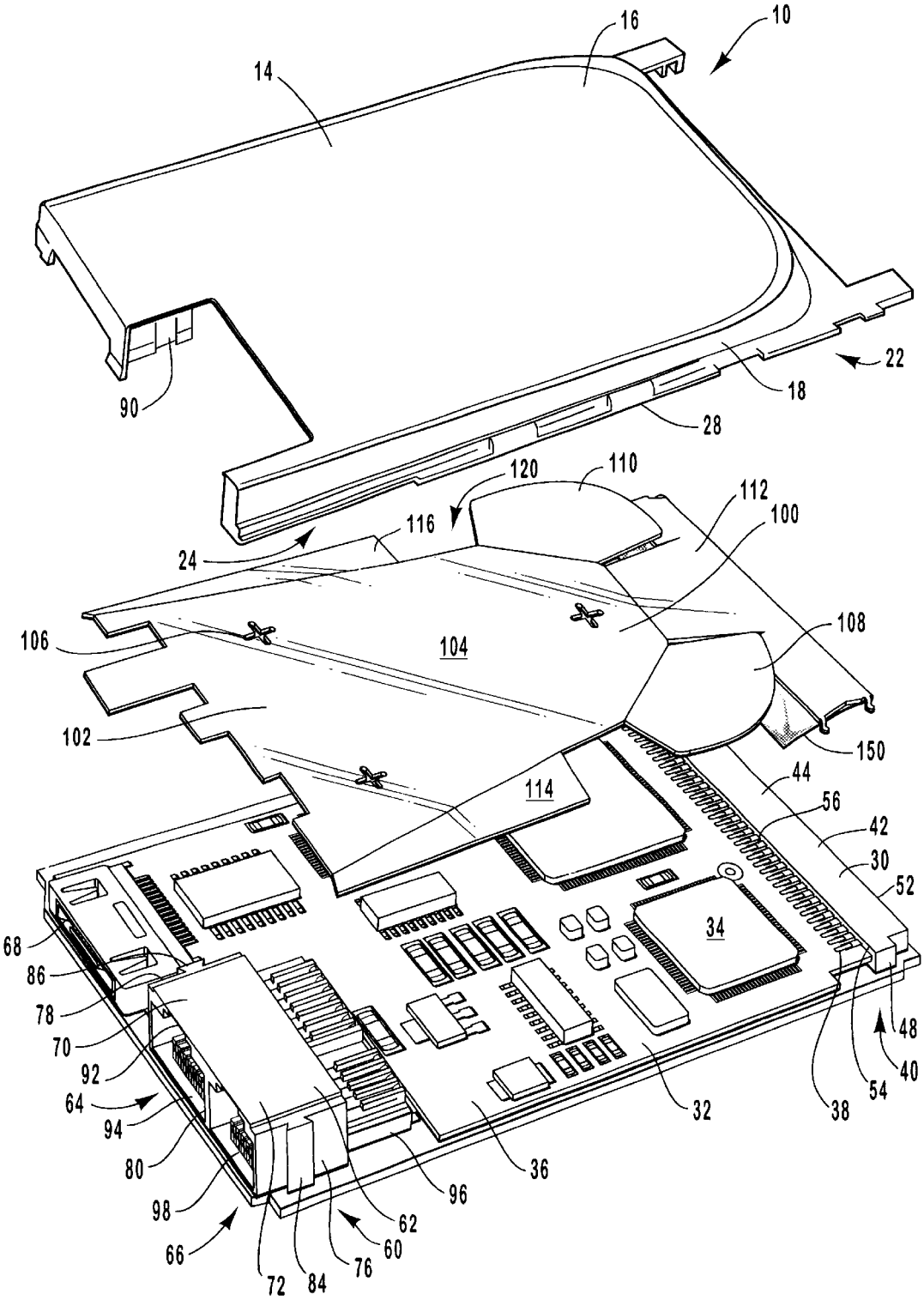
FIG. 4 is an exploded perspective view of the communications card shown in FIG. 2, illustrating the top cover, conductive panel and substrate.

As seen in FIG. 4, a printed circuit board (PCB) or substrate 32 is disposed within the communications card 10 and it includes logic circuitry and various components 34 that are used to perform the desired functions of the communications card 10. The substrate 32 also includes an upper surface 36 and a plurality of electrically conductive traces 38 that are disposed proximate a forward end 40 of the communications card 10. The traces 38, which preferably have a standard spacing or pitch, are connected to the various components 34 and circuitry of the substrate 32. The traces 38 are also connected to the connector 30, which is preferably a 68-pin connector. The 68-pin connector 30 includes a molded plastic body 42 with an upper surface 44, lower surface 46, right side 48, left side 50, front surface 52 and rear surface 54. The front surface 52 of the connector 30 includes upper and lower transverse rows of longitudinally extending openings (not shown) that each contain a contact for receiving a corresponding pin from the receiving pin connector. Extending from the rear surface 54 of the connector 30 are contact fingers 56 that are connected to associated conductive traces 38 on the upper surface 36 of the substrate 32. Preferably, in accordance with the PCMCIA standards, the 68 pins of the connector 30 are arranged in two rows of 34 contacts each, with the pin at the end of each row (corresponding to pin numbers 1, 34, 35 and 68) being connected to ground. It will be understood, however, that the connector 30 may have any suitable size, configuration and number of pins.

As seen in FIGS. 2 and 4, located at a rear end 60 of the communications card 10 is a modular jack 62 with receptacles 64 and 66 that are sized and configured to receive conventional RJ series plugs. Preferably, the receptable 64 is sized and configured to receive a RJ-11 connector plug and the receptacle 66 is sized and configured to receive a RJ-45 connector plug, but it will be appreciated that the receptacles can be sized and configured to receive any desired RJ series plug or any other suitable type of plug. A preferred embodiment of the receptacles 64 and 66 are described in assignee's copending U.S. patent application Ser. No. 09/528,331, entitled Modular Jack for Type III PCMCIA Cards which is hereby incorporated by reference in its entirety. The receptacles 64 and 66 may also be illuminated as shown in assignee's copending U.S. Patent application Ser. No. 09/528,330, entitled Illuminated Electrical Jack System, which is hereby incorporated by reference in its entirety.

The rear end 60 of the card 10 also includes a Sub-D connector 68 for connection to a cellular telephone or other suitable electronic equipment, but other types of connectors such as a pin, BNC or DIN connectors may also be connected to the communications card. Additionally, another modular jack 62 or additional receptacles of suitable sizes and configurations may also be attached to the rear portion of the communications card 10.

Figure 6:
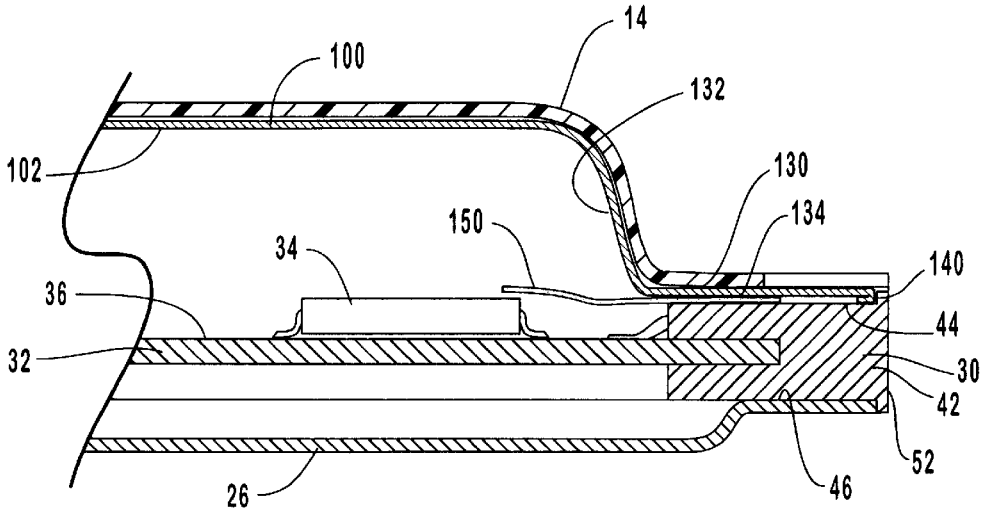
FIG. 6 is a cross-sectional side view along lines 6—6 of the communications card shown in FIG. 2.

In greater detail, the modular jack 62 includes a main body portion 70 with an upper surface 72, a lower surface 74, a right side 76, a left side 78, a front surface 80 and a rear surface 82. As shown in FIG. 2, the upper surface 72 of the modular jack 62 is generally aligned and substantially planar with the upper surface 16 of the top cover 14 of the communications card 10. Alternatively, the upper surface 16 of the top cover 14 may be configured to cover the upper surface 72 of the modular jack 62. The lower cover panel 26 of the card 10 preferably encloses the lower surface 74 of the modular jack 62 and is generally aligned with a lip located proximate the front surface 80 of the modular jack, as seen in FIG. 6. On the other hand, the lower surface 74 of the modular jack 62 may be generally aligned with the lower cover panel 26 of the communications card 10. In any of these configurations, however, the height of the modular jack 62 is the generally equal to or less than the height of the communications card 10. Additionally, as shown in the accompanying figures, the receptacles 64 and 66 are located entirely in the front surface 80 of the modular jack 62, and the upper surface 72 and lower surface 74 of the modular jack 62 are solid, planar surfaces that do not include any openings or cutouts to receive the biased clip of a RJ type connector.

The modular jack 62 is releasably attached to the top cover 14 of the communications card 10 by a pair of guide rails 84 and 86 that are located on the right and left sides 76, 78 of the jack, respectively. These guide rails 84, 86 have a dovetail shape and are received within corresponding slots 88, 90 located in the top cover 14 of the communications card 10. The guide rails 84, 86 preferably have a friction or interference fit with the corresponding slots 88, 90 to securely attach the modular jack 62 to the top cover 14 of the communications card 10. Because the modular jack 62 is securely attached to the top cover 14 of the communications card 10, forces associataed with inserting and removing connector plugs from the receptacles are primarily transmitted to the top cover and not the substrate 32.

In a preferred embodiment, the main body portion 70 of the modular jack 62 has a height of about 10.5 mm measured from the upper surface 72 to the lower surface 74, and the receptacles 64, 66 have a height of about 10.1 mm measured from an uppermost surface 92 to a lower surface 94 of the receptable. The modular jack 62 also includes a rearwardly extending connector 96 projecting from the rear surface of the jack that is used to electrically connect the jack to the substrate 32. A preferred embodiment for connecting the modular jack 62 to the substrate 32 is disclosed in assignee's copending U.S. patent application Ser. No. 09/528,501, entitled Card Edge Connector for a Modular Jack, which is hereby incorporated by reference in its entirety. One skilled in the art will readily appreciated that the modular jack 62 can have a variety of different sizes and configurations depending, for example, upon the type of connectors, intended use of the communications card, size and shape of the communications card, and specific applications of the communications card.

One or more contact pins 98 are located within the receptacles 64, 66 of the modular jack 62. Typically, four or six contact pins 98 are used in conjunction with an RJ-11 connector and eight contact pins are used in conjunction with an RJ-45 connector, but any suitable number of contact pins may be utilized. Preferred embodiments of the contact pins 98 are disclosed in assignee's copending U.S. patent application Ser. No. 09/528,500, entitled Contact Pin Design for a Modular Jack, which is hereby incorporated by reference in its entirety. It will be appreciated that the contact pins may be manufactured in any of a wide variety of designs and configurations in order to be used with specific applications or connectors. Thus, it will be understood that the contact pins may also have other suitable shapes and configurations.

Figure 3:
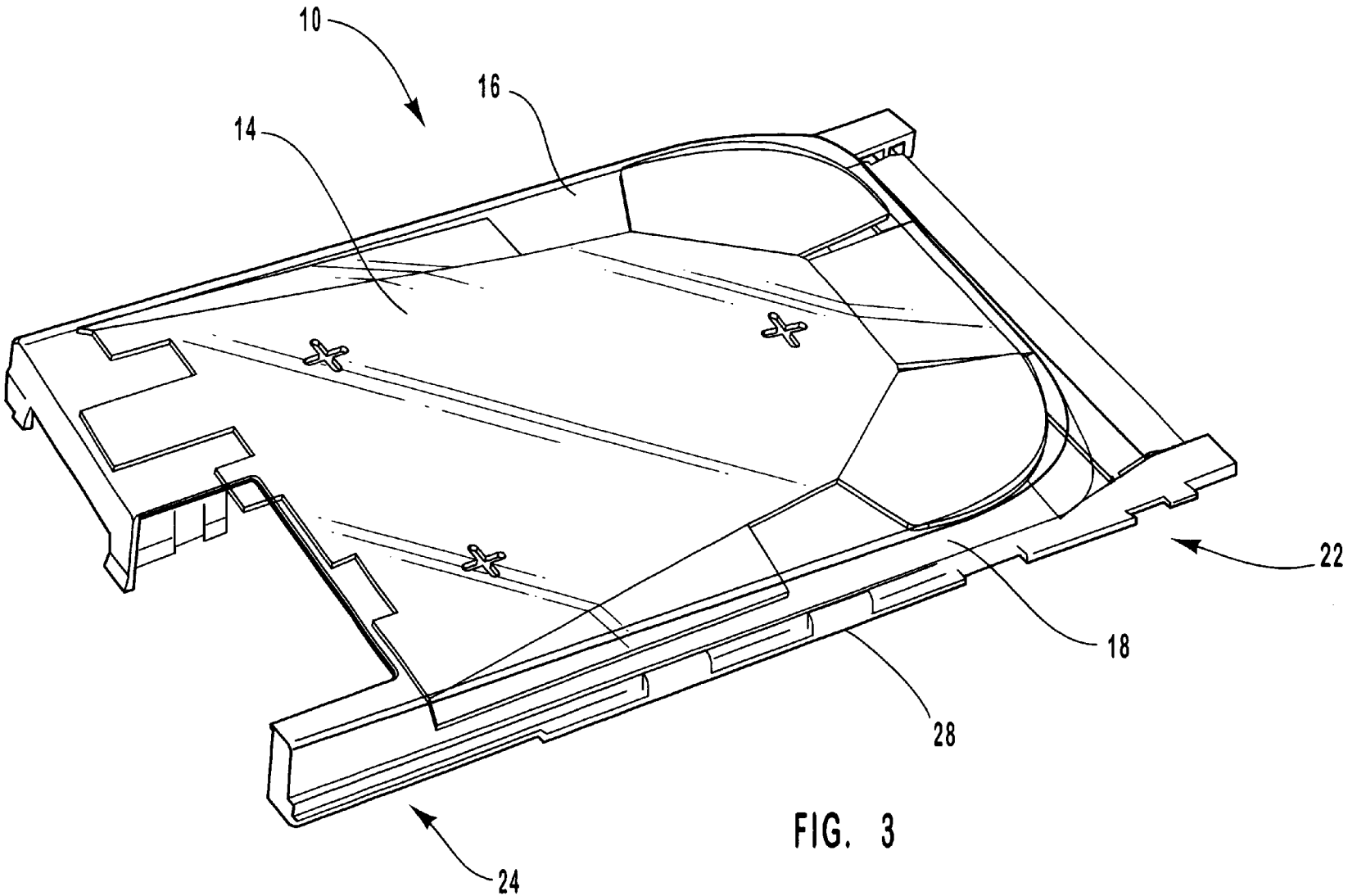
FIG. 3 is a perspective view of the top cover and conductive panel of the communications card shown in FIG. 2, illustrating the top cover as being generally transparent.

As best seen in FIGS. 3 and 4, the communications card 10 includes the top cover 14 and a conductive panel 100. The top cover 14 is constructed of a dielectric or non-conductive material such as plastic. Preferably, the top cover 14 is constructed of plastic material such as polycarbonate or styrene. More preferably, the top cover 14 is constructed of acrylonitrile butadiene styrene (ABS) because it is easily machined and has high rigidity, impact strength and abrasion resistance, but it will be appreciated that other suitable materials with the desired characteristics may also be used to construct the top cover. Additionally, the top cover 14 may be constructed of a transparent material as shown in FIG. 3, or a translucent or opaque material as shown in FIG. 4.

The conductive panel 100 of the communications card 10 is constructed from a conductive material such as metal to prevent or decrease the emission of electromagnetic radiation. In particular, as discussed below, the conductive panel 100 is electrically connected to the lower cover panel 26 of the communications card 10 to provide the desired EMI protection for the card. The conductive panel 100 is preferably constructed from carbon or stainless steel, but it can be constructed from other suitable materials such as copper, aluminum, etc. The conductive panel 100 may be formed, for example, by pressing or stamping sheet metal into the desired shape.

Figure 5:
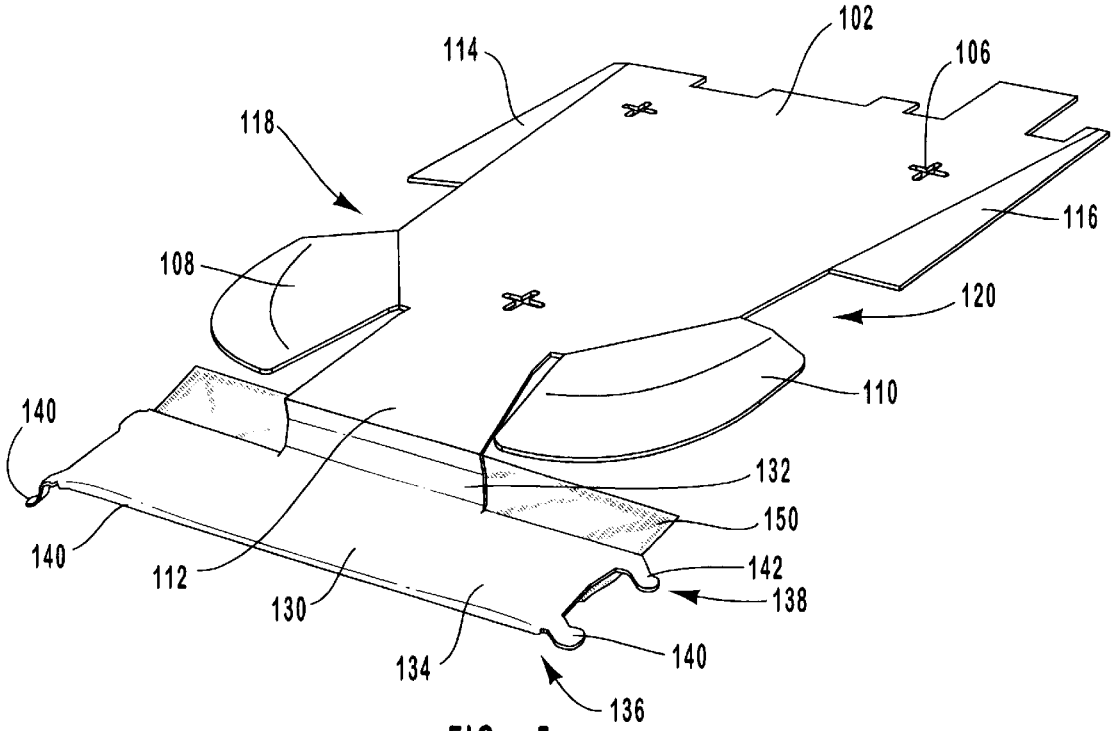
FIG. 5 is a perspective view of a portion of the communications card shown in FIG. 2, illustrating the conductive panel.

As best seen in FIGS. 4 and 5, the conductive panel 100 has a main body portion 102 that is sized and configured to fit within the inner surface of the top cover 14. In greater detail, the conductive panel 100 includes a generally planar top surface 104 that is configured to contact or be positioned proximate the inner surface of the top cover 14. The conductive panel 100 may include one or more openings 106 that are configured to receive corresponding projections extending from the inner surface of the top cover 14 to position or attach the panel to the top cover. Preferably, the openings 106 are sized and configured to receive to projections to create a friction or interference fit, but the conductive panel may also be attached to the top cover by other suitable means such as adhesives, mechanical connectors, ultrasonic bonding, heat stakes, comolding and the like.

The conductive panel 100 also includes a right portion 108, a left portion 110 and a central portion 112 that are located towards the front end 40 of the card 10. The conductive panel 100 also includes a right rear portion 114 and a left rear portion 116 located proximate the rear end 60 of the card 10. In addition, the conductive panel 100 includes cutouts 118, 120 to accommodate various components 34 positioned on the upper surface 36 of the substrate 32. These components 108–120 are sized and configured to conform to the inner surface of the top cover 14 so that the conductive panel 100 can abut or be positioned proximate the inner surface of the top cover. Additionally, these components 108–120 may be sized and configured such that the card 10 has the desired EMI characteristics. Advantageously, the conductive panel 100 and the top cover 14 may be integrally constructed, simultaneously constructed, constructed using the same equipment or otherwise manufactured such that the conductive panel fits within the inner surface of the top cover.

As best seen in FIG. 4, the conductive panel 100 is disposed between the inner surface of the top cover 14 and the upper surface 36 of the substrate 32. The conductive panel 100 preferably covers substantially the entire inner surface of the top cover 14 or upper surface 36 of the substrate 32, but the panel may only cover a portion of the top cover or substrate. Further, the conductive panel may be constructed from one or more components that cover the desired portions or the inner surface of the top cover or substrate.

As best seen in FIGS. 5 and 6, the conductive panel 100 also includes an extension 130 that is connected to the central portion 112 of the panel and it covers the upper surface 44 of the body 42 of the connector 30. In particular, the extension includes a first section 132, which is positioned generally perpendicular to the upper surface 36 of the substrate 32 and a second section 134 that is generally positioned parallel to the upper surface 36 of the substrate 32. The second section 134 has a generally rectangular configuration with a front end 136, which is positioned proximate the front end 40 of the communications card 10, and a rear end 138. Although not shown in the accompanying figures, the second section 134 desirably includes one or more downwardly curved or angled sections that are sized and configured to deflect or deform when the second section abuts the upper surface 44 of the connector 30. This provides for a secure engagement between the section section 134 of the extension 130 and the top surface 44 of the connector 30.

The second section 134 of the extension 130 extends generally the entire length of the connector 40 and covers the majority of the upper surface 44 of the connector to protect the connector from damage. The extension 130 also covers both the connection of the connector 40 to the substrate 32 and the upper surface 44 of the connector to reduce the emission of electromagnetic radiation. Additionally, the extension 130 desirably fills the gap between the connector 30 and the top cover 14 to prevent foreign objects and material from entering the card 10.

The extension 130 includes an edge 140 that is positioned proximate the front surface 52 of the connector 30. The front end 136 of the extension 130 is folded back upon itself at the 180° angle so that the forward edge 140 has a double thickness. Advantageously, because the edge 140 is folded over upon itself, the edge has no sharp edges or protrusions. Additionally, this provides the edge 140 with additional strength and helps prevent bending of the edge. The edge 140 preferably has a thickness of between about 0.008 to about 0.010 inches (0.203 to 0.254 mm) or smaller to allow the connector 30 to be electrically coupled to a receiving pin connector located in the slot of the host device 12. Thus, the edge 140 covers and protects the connector 30, while allowing the card 10 to be used in connection with standard pin connectors used in connection with electronic devices such as computers.

Located proximate the front end 136 of the generally rectangular section 134 is a first pair of tabs 140 that extend outwardly from the extension 130. The first pair of tabs 140 are inserted into corresponding slots or openings (not shown) in the top cover 14 to attach or position the extension 130 to the top cover. The extension 130 also includes a second pair of tabs 142 that are positioned proximate the rear end 138 of the extension. The second pair of tabs 142 extend downwardly and are electrically connected to the lower cover panel 26. The lower cover panel 26 is typically connected to ground when the card 10 is inserted into the host device 12. Thus, a ground path from the conductive panel 100 to the lower cover panel 26 and to the host device 12 is established when the card 10 is inserted into the host device.

As shown in FIGS. 5 and 6, an insulator 150 is attached to the extension 130. The insulator 150 is preferably attached to the generally rectangular section 134 of the extension 130 and it extends inwardly into the body of the card 10. The insulator 150 is used to electrically insulate a portion of the conductive panel 100 from the connector 30. Desirably, the insulator 150 is positioned to insulate the rear portion 54 of the connector 30 from the conductive panel 100 to prevent electrical communication between the connector and the conductive panel. The insulator 150 may also be used to electrically insulate desired portions of the substrate 32 and/or components 34 from the conductive panel 100. The insulator 150 is preferably constructed from a dielectric material, such as non-conductive tape, that insulates to at least about 1.5 kilovolts. The insulator 150, however, could have different characteristics and properties depending, for example, upon the desired use of the card 10.

Figure 7:
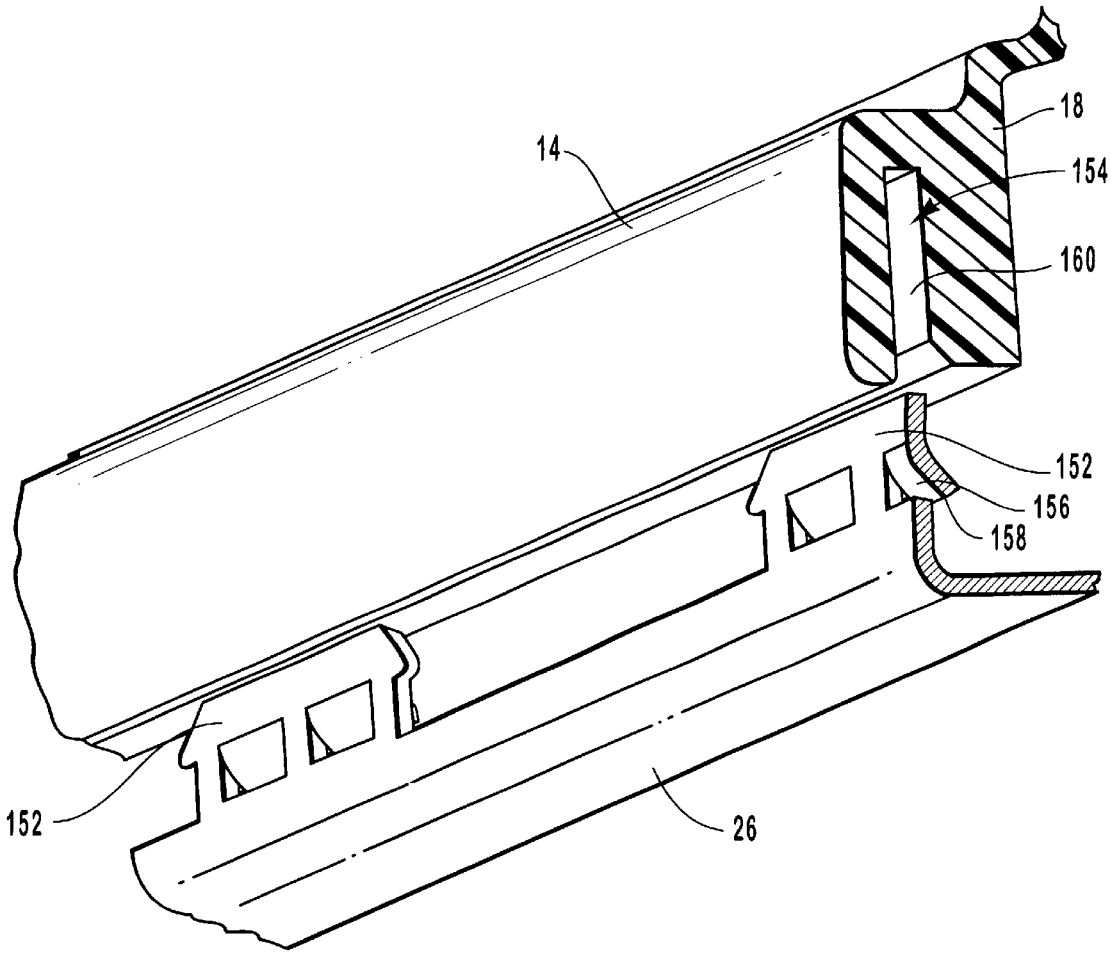
FIG. 7 is an exploded perspective view of a portion of the communications card shown in FIG. 2, illustrating a portion of the top cover and lower cover, with a portion of the communications card cut away.

As seen in FIG. 7, the lower cover panel 26 of the communications card 10 is connected to the top cover 14 by one or more tabs 152. In particular, the top cover 14 includes one or more grooves or openings 154 disposed in the lower surfaces 28 of the right and left sidewalls 18, 20 and the tabs 152 are sized and configured to be inserted into these openings. The tabs 152 include barbs 156 that provide for easy insertion of the tabs into the corresponding openings 154, but the barbs also include edges 158 that engage the side walls 160 of the openings as the tabs are inserted to prevent the unintended removal of the lower cover panel 26 from the top cover 14.

The lower cover panel 26 is also preferably secured to the top cover 14 by ultrasonic bonding of the tabs 152 to the openings 154. Desirably, because the top cover 14 is preferably constructed of plastic and the lower cover panel 26 is constructed from metal, the ultrasonic bonding causes the plastic to flow about the barbs 156 to securely connected the top cover and lower cover panel. Additionally, ultrasonic energy may be applied to the top cover 14 or lower cover panel 26 while inserting the tabs 152 into the openings 154 to allow the barbs 156 to engage the softened plastic. It will be appreciated that while ultrasonic bonding is preferred, any known energy for causing the plastic to flow may be used. Further, while the energy may be applied in any known manner, it is preferred that the energy be applied to the lower cover panel 26 because it is a good conductor of energy and applying energy directly to the top cover 14 may blemish or damage the top cover.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. A communications card for insertion into a receiving slot in an electronic device, the communications card comprising:

a top cover including an upper surface, a right sidewall and a left sidewall that form a portion of a housing, the housing including an inner surface and an outer surface, the top cover being constructed from a generally non-conductive material;

a substrate disposed within the housing formed by the top cover, the substrate including a top surface, a bottom surface, a front end and a rear end;

a connector attached to the front end of the substrate, the connector being sized and configured to connect the communications card to the electronic device;

a conductive panel disposed between the substrate and the inner surface of the top cover, the conductive panel covering at least a portion of an upper surface of the connector, the conductive panel being sized and configured to decrease the emission of electromagnetic radiation from the communication card; and a lower cover panel attached to the top cover, the lower cover panel being constructed of a conductive material and being electrically connected to the conductive panel.

2. The communications card as in claim 1, wherein the conductive panel overlies a substantial portion of the substrate in order to decrease the electromagnetic radiation emitted by the communications card.

3. The communications card as in claim 1, wherein the conductive panel and lower cover panel are electrically connected to ground when the communications card is inserted into the electronic device in order to decrease the electromagnetic radiation emitted by the communications card.

4. The communications card as in claim 1, wherein the conductive panel is attached to the inner surface of the top cover.

5. The communications card as in claim 1, wherein the conductive panel has generally the same size and configuration as at least a portion of the inner surface of the top cover.

6. The communications card as in claim 1, wherein the communications card conforms to the standards established for a PCMCIA Type III card.

7. The communications card as in claim 1, further comprising a insulator disposed between an inner surface of the conductive panel and the upper surface of the substrate, the insulator being sized and configured to prevent electrical communication between the conductive panel and the substrate.

8. The communications card as in claim 1, further comprising a modular jack for receiving a RJ-type connector plug attached to the top cover panel, the modular jack including a main body portion with a top surface, a bottom surface and a front surface; and further comprising a receptacle disposed entirely within the front surface of the modular jack such that no portion of a corresponding RJ-type connector plug extends through either the top surface or the bottom surface of the main body portion of the modular jack.

9. The communications card as in claim 8, wherein the main body portion of the modular jack has a height measured from the top surface to the bottom surface that is generally equal to or less than about 10.5 mm.

10. The communications card as in claim 8, further comprising an upper inner surface of the receptacle and a lower inner surface of the receptacle that are separated by a distance that is generally equal to or less than about 10.1 mm.

11. A Type III PCMCIA card that is sized and configured to be electronically connected to a host device, the card comprising:

a dielectric top cover, the top cover including an inner surface and an outer surface;

a substrate including an upper surface, a lower surface, a front end and a rear end;

a connector attached to the front end of the substrate, the connector being sized and configured to connect the card to the host device; and a conductive panel having generally the same size and configuration as at least a portion of the inner surface of the top cover, the conductive panel being disposed between the upper surface of the substrate and the inner surface of the top cover.

12. The Type III PCMCIA card as in claim 11, further comprising a lower cover panel that is attached to the top cover, the lower cover panel being constructed of a conductive material and being electrically connected to the conductive panel.

13. The Type III PCMCIA card as in claim 11, wherein the conductive panel overlies a substantial portion of the substrate in order to decrease the electromagnetic radiation emitted by the communications card.

14. The Type III PCMCIA card as in claim 11, wherein the conductive panel and lower cover panel are electrically connected to ground when the communications card is inserted into the electronic device in order to decrease the electromagnetic radiation emitted by the communications card.

15. The Type III PCMCIA card as in claim 11, further comprising a insulator disposed between an inner surface of the conductive panel and the upper surface of the substrate, the insulator being sized and configured to prevent electrical communication with the conductive panel.

16. The Type III PCMCIA card as in claim 11, further comprising a modular jack attached to the substrate, the modular jack having a height generally less than or equal to about 10.5 mm, the modular jack including a front face with an opening.

17. The Type III PCMCIA card as in claim 11, further comprising a modular jack attached to the top cover panel, the modular jack including a main body portion with a top surface, a bottom surface and a front surface; and further comprising a receptacle disposed entirely within the front surface of the modular jack such that no portion of a corresponding plug extends through either the top surface or the bottom surface of the main body portion of the modular jack.

18. The Type III PCMCIA card as in claim 17, wherein the main body portion of the modular jack has a height measured from the top surface to the bottom surface that is generally equal to or less than about 10.5 mm.

19. The Type III PCMCIA card as in claim 17, further comprising an upper inner surface of the receptable and a lower inner surface of the receptacle that are separated by a distance that is generally equal to or less than about 10.1 mm.

20. A communications card comprising:

a dielectric top cover, the top cover including an inner surface and an outer surface;

a conductive panel disposed proximate the inner surface of the top cover, the conductive panel including an upper surface and a lower surface;

a substrate disposed proximate the lower surface of the conductive panel, the substrate including an upper surface, a lower surface, a front end and a rear end;

a connector attached to the front end of the substrate, the connector being sized and configured to connect the card to the host device; and a conductive lower cover panel disposed proximate the lower surface of the substrate, the conductive lower cover panel being electrically connected to the conductive panel.

21. The communications card as in claim 1, wherein the conductive panel closes at least a portion of a gap between the connector and the top cover.

22. The communications card as in claim 1, wherein the conductive panel provides protection for the upper surface of the connector from foreign object damage.

23. The communications card as in claim 1, wherein the conductive panel closes substantially the entire gap between the connector and the top cover.

24. The communications card as in claim 1, wherein the conductive panel covers substantially the entire upper surface of the connector.

25. A Type III PCMCIA card that is sized and configured to be electronically connected to a host device, the card comprising:

a dielectric top cover, the top cover including an inner surface and an outer surface;

a substrate including an upper surface, a lower surface, a front end and a rear end;

a connector attached to the front end of the substrate, the connector being sized and configured to connect the card to the host device; and a conductive panel having generally the same size and configuration as at least a portion of the inner surface of the top cover, the conductive panel being disposed between the upper surface of the substrate and the inner surface of the top cover, the conductive panel including an extension that covers at least a portion of an upper surface of the connector; and a lower cover panel attached to the top cover, the lower cover panel being constructed of a conductive material and being electrically connected to the conductive panel;

wherein the conductive panel and lower cover panel are electrically connected to ground when the communications card is inserted into the host device in order to decrease the electromagnetic radiation emitted by the communications card.

26. The communications card as in claim 25, wherein the conductive panel and the extension close at least a portion of a gap between the connector and the top cover.

27. The communications card as in claim 25, wherein the extension provides protection for the upper surface of the connector from foreign object damage.

28. The communications card as in claim 25, wherein the conductive panel and the extension close substantially the entire gap between the connector and the top cover.

29. The communications card as in claim 25, wherein the extension covers substanially the entire upper surface of the connector.

30. The communication card as in claim 25, further comprising a insulator disposed between an inner surface of the conductive panel and the upper surface of the substrate, the insulator being sized and configured to prevent electrical communication between the conductive panel and the substrate.

31. The communications card as in claim 25, further comprising a modular jack for receiving a RJ-type connector plug attached to the top cover panel, the modular jack including a main body portion with a top surface, a bottom surface and a front surface; and further comprising a receptable disposed entirely within the front surface of the modular jack such that no portion of a corresponding RJ-type connector plug extends through either the top surface of the bottom surface of the main body portion of the modular jack.

32. The communications card as in claim 31, wherein the main body portion of the modular jack has a height measured from the top surface to the bottom surface that is generally equal to or less than about 10.5 mm.

33. The communications card as in claim 31, further comprising an upper inner surface of the receptacle and a lower inner surface of the receptacle that are separated by a distance that is generally equal to or less than about 10.1 mm.

* * * * *

UNITED STATES PATENT AND TRADEMARK OFFICE

CERTIFICATE OF CORRECTION

PATENT NO. : 6,333,860 B1 
DATED : December 15, 2001
INVENTOR(S) : David Oliphant, Brent Madsen and Michael Cochrane It is certified that error appears in the above-identified patent and that said Letters Patent is hereby corrected as shown below:

Column 1,
Line 40, change "(RAM)" to -- (ROM) --.

Column 3,
Line 35, before "insulator" change "the" to -- The --.

Column 7,
Line 34, after "receive" change "to" to -- the --.

Column 12,
Line 51, after "surface" change "of" to -- or --.

Signed and Sealed this

Twenty-fifth Day of October, 2005

JON W. DUDAS
*Director of the United States Patent and Trademark Office*